US008384751B2

(12) United States Patent
Arauchi

(10) Patent No.: US 8,384,751 B2
(45) Date of Patent: Feb. 26, 2013

(54) THERMAL HEAD

(75) Inventor: Susumu Arauchi, Miyagi-Ken (JP)

(73) Assignee: Alps Electric Co., Ltd., Tokyo (JP)

( * ) Notice: Subject to any disclaimer, the term of this patent is extended or adjusted under 35 U.S.C. 154(b) by 172 days.

(21) Appl. No.: 13/082,242

(22) Filed: Apr. 7, 2011

(65) Prior Publication Data

US 2011/0261134 A1 Oct. 27, 2011

(30) Foreign Application Priority Data

Apr. 21, 2010 (JP) ..... 2010-097855

(51) Int. Cl.
*B41J 2/35* (2006.01)
*B41J 2/335* (2006.01)

(52) U.S. Cl. ..... 347/211; 347/208

(58) Field of Classification Search ..... 347/200–209, 347/211
See application file for complete search history.

(56) References Cited

U.S. PATENT DOCUMENTS 4,689,638 A * 8/1987 Matsuzaki et al. ..... 347/209
4,996,487 A * 2/1991 McSparran et al. ..... 347/200
5,491,566 A * 2/1996 Oh et al. ..... 347/211
5,557,313 A * 9/1996 Nakayama et al. ..... 347/203
5,786,839 A * 7/1998 Itoh ..... 347/211
6,652,058 B2 * 11/2003 Kanematsu et al. ..... 347/211

FOREIGN PATENT DOCUMENTS

JP 62-282950 12/1987
JP 2010-5794 1/2010

* cited by examiner

*Primary Examiner* — Kristal Feggins
(74) *Attorney, Agent, or Firm* — Beyer Law Group LLP

(57) ABSTRACT

A thermal head includes an insulating head substrate, one or a plurality of driver ICs, a plurality of heat generating elements that is arranged on the head substrate in a main scanning direction, a plurality of individual electrodes that is provided on the head substrate at one ends of the respective heat generating elements and connects the respective heat generating elements to the driver ICs, and a common electrode that is provided on the head substrate at the other ends of the respective heat generating elements so as to be common to the heat generating elements. Capacitance adjustment portions, which adjust capacitance difference between the respective individual electrodes so that the capacitance difference is reduced, are formed at a wiring pattern of the individual electrodes.

5 Claims, 4 Drawing Sheets

THERMAL HEAD

CLAIM OF PRIORITY

This application claims benefit of Japanese Patent Application No. 2010-097855 filed on, Apr. 21, 2010, which is hereby incorporated by reference.

BACKGROUND OF THE INVENTION

1. Field of the Invention

The present invention relates to a thermal head that is used in a printing unit of a printer.

2. Description of the Related Art

A thermal head 1, which is mounted on a printing unit of a printer, includes a head substrate 2 as shown in FIG. 7. A heat storage layer 3*a*, which is made of an insulating material such as glass, is formed on the head substrate 2. A partial glaze 3*b*, which is formed in a cylindrical shape, is formed at a part of the heat storage layer 3*a*. Heating resistor layers 4 are stacked on the heat storage layer 3 so as to have a predetermined width in a main scanning direction. A heat generating element 6 is formed of the heating resistor layers 4 and electrodes E that are formed on the heating resistor layers 4 and made of Al through which current flows. Further, a protective layer 11 is formed. The protective layer 11 is made of an abrasion-resistant material such as SiAlON or Ta2O5, covers the heating resistor layers 4 and the electrode layer E of the heat generating element 6, and protects the surfaces of the heating resistor layers and the electrode layer. A plurality of driver ICs 12 (see FIG. 8), which is aligned in a main scanning direction orthogonal to a recording sheet conveying direction (in a width direction of a recording sheet), is provided on the head substrate 2 or a printed-circuit board (not shown) that is closely provided. When being provided on the printed-circuit board, the driver ICs 12 are connected to the electrode layer E, which is formed on the head substrate 2, by wire bonding or the like.

Here, the heat storage layer 3 is a glaze layer formed on the head substrate 2, and is formed so as to extend in the main scanning direction. Further, the heating resistor layers 4 are partially formed on the heat storage layer 3, and are made of a cermet material such as Ta2N or Ta—SiO2. The electrode layer E includes individual electrodes 9 that are connected to one ends of the heating resistor layers 4 in a sub-scanning direction, and a common electrode 10 that is connected to the other ends of the heating resistor layers 4 in the sub-scanning direction.

Here, the individual electrodes 9 are electrodes that individually supply current to the respective heating resistor layers 4, and the common electrode 10 is an electrode that applies a common potential to the plurality of heating resistor layers 4. The individual electrodes 9 are formed of strip-shaped electrodes, which extend in a longitudinal direction of the heating resistor layer 4 and are formed of thin metal films as conductors, and are connected to terminals 12*a* of the plurality of driver ICs 12 that switches the electrical connection/disconnection of the corresponding individual electrodes 9.

Here, in the thermal head 1, the individual electrodes 9, which are connected to the terminals 12*a* of one driver ICs 12, are typically formed of a wiring pattern that spreads toward the corresponding heat generating elements 6 from the respective terminals 12*a* in the shape of a symmetrical fan due to various reasons, such as a resistance value and dimensional difference between the terminal and the heat generating element. That is, the wiring pattern of the individual electrodes 9 of the thermal head 1 is formed in a radial shape (in the shape of ribs of a fan) where the length of the individual electrode 9 disposed in the middle is shorter than those of the individual electrodes 9 connected to the end portions of each driver IC 12 as shown in FIG. 8.

In the thermal head 1, the variation of the resistance values of the individual electrodes 9, which are connected to the individual heat generating elements 6, affects the heat generation of the heat generating elements 6, generates unevenness in printing density, and causes a good printing result not to be obtained. Various correction methods have been proposed focusing on this (see Japanese Unexamined Patent Application Publication Nos. 2010-5794 and 62-282950).

SUMMARY OF THE INVENTION

However, a cause, which generates unevenness in printing density by the influence on the heat generation of the heat generating elements 6, is not limited to the above-mentioned variation of the resistance values of the individual electrodes 9, and may be variation in heat radiation property that is caused by the difference in capacitance (volume) of the individual electrodes 9.

The present invention provides a thermal head that can suppress variation in heat radiation property and variation of resistance values by the reduction of the capacitance difference of individual electrodes, remove unevenness in printing density by making the heat generation of heat generating elements be uniform, and obtain a good printing result.

According to an aspect of the invention, a thermal head includes an insulating substrate, one or a plurality of driver ICs, a plurality of heat generating elements that is arranged on the substrate in a main scanning direction, a plurality of individual electrodes that is provided on the substrate at one ends of the respective heat generating elements and connects the respective heat generating elements to the driver ICs, and a common electrode that is provided on the substrate at the other ends of the respective heat generating elements so as to be common to the heat generating elements. Capacitance adjustment portions, which adjust capacitance difference between the respective individual electrodes so that the capacitance difference is reduced, are formed at a wiring pattern of the individual electrodes.

Further, the wiring pattern of the individual electrodes may be formed so that the wiring resistances of the respective individual electrodes are adjusted so as to be constant.

Specifically, at least one branch line, which laterally extends from main lines, may be formed at main lines of the wiring pattern of the individual electrodes, which connect the driver IC to heat generating elements, as the capacitance adjustment portions, and adjust the wiring resistance of each of the individual electrodes so that the wiring resistance of each of the individual electrodes including the capacitance adjustment portions is constant.

Furthermore, main lines of the wiring pattern of the individual electrodes, which connect the driver IC to heat generating elements, may be formed in a meandering shape so that the capacitance adjustment portions are formed. Alternatively, conductors of main lines of the wiring pattern of the individual electrodes, which connect the driver IC to the heat generating elements, may be formed so as to be partially thick as the capacitance adjustment portions, and adjust the wiring resistance of each of the individual electrodes so that the wiring resistance of each of the individual electrodes including the capacitance adjustment portions is constant.

The capacitance adjustment portions are formed at the wiring pattern of the individual electrodes as described above, so that the capacitance difference between the respective individual electrodes connected to the heat generating elements arranged in the main scanning direction of the thermal head is reduced and variation in heat radiation property is suppressed. Accordingly, it may be possible to suppress variation in the heat distribution of the heat generating elements. Further, it may be possible to adjust the resistance value of the wiring pattern of each individual electrode by partially reducing the width or thickness of the capacitance adjustment portion or adjusting the width, thickness, or the like of the wiring pattern of the individual electrodes when the capacitance adjustment portions are formed. Accordingly, it may be possible to make the heat generation of the heat generating elements be uniform.

The thermal head according to the aspect of the invention has an excellent effect of removing unevenness in printing density by making the heat generation of heat generating elements be uniform, and obtaining a good printing result.

DESCRIPTION OF THE PREFERRED EMBODIMENTS

A wiring pattern of individual electrodes of a thermal head according to an embodiment of the invention will be described below. Meanwhile, as long as description is not particularly added, a thermal head according to an embodiment of the invention has the same configuration as the configuration of the above-mentioned thermal head in the related art.

In this embodiment, capacitance adjustment portions 13 for adjusting difference in capacitance (volume) of conductors of the respective individual electrodes 9 (hereinafter, simply referred to as "capacitance difference") so that the capacitance difference is reduced are formed at a wiring pattern of individual electrodes 9 that electrically connect a driver IC 12 to respective heat generating elements 6, and the wiring pattern of the individual electrodes 9 is formed so that the wiring resistances of the respective individual electrodes 9 are adjusted so as to be constant.

Figure 1:
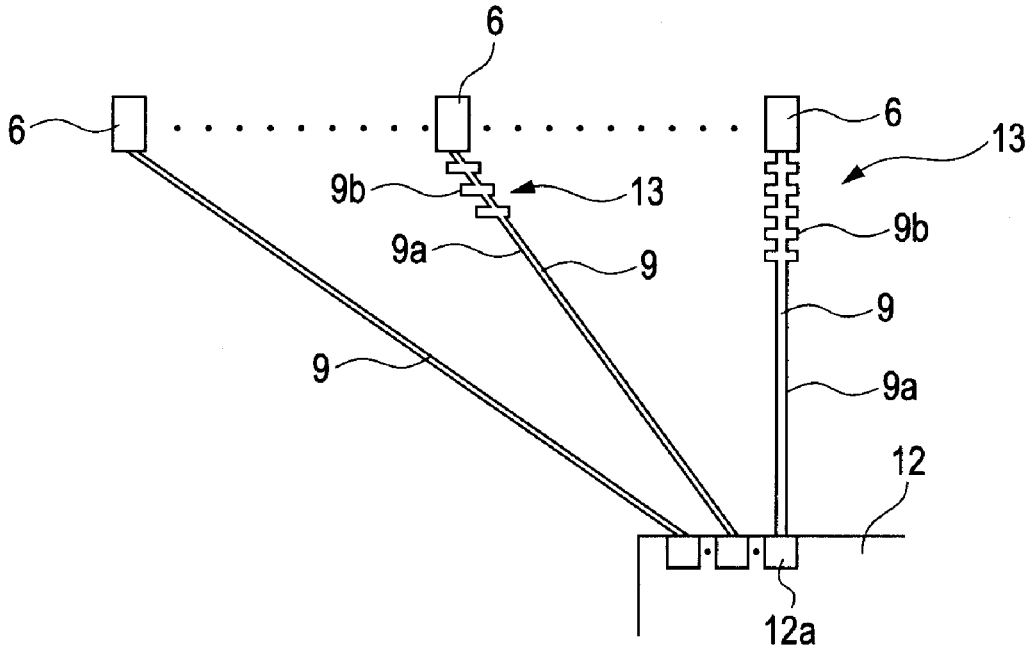
FIG. 1 is a view showing the configuration of main parts of a thermal head according to an embodiment of the invention.
Figure 7:
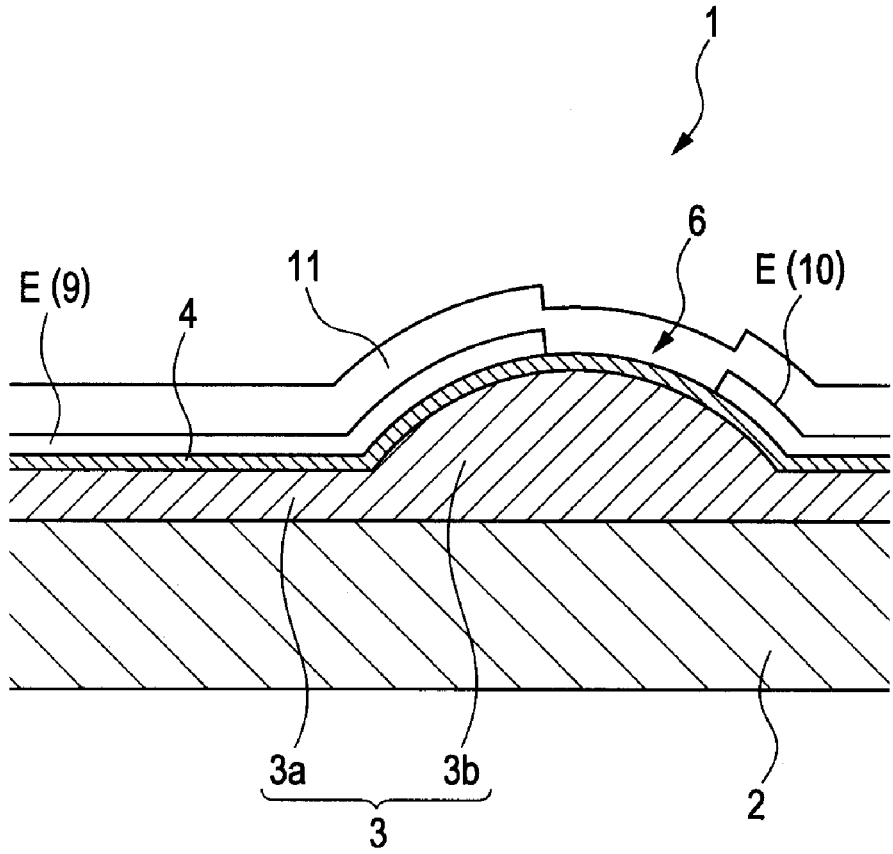
FIG. 7 is a cross-sectional view of main parts that shows the shape of a heat generating element of a thermal head.

Specifically, branch lines 9*b*, which laterally extend from main lines 9*a*, are formed at main lines 9*a* of the wiring pattern of the individual electrodes 9, which connect terminals 12*a* of the driver IC 12 to heating resistor layers 4 of the heat generating elements 6, as shown in FIGS. 1 and 7, so that the capacitance adjustment portions 13 are formed. Further, the capacitance difference is adjusted by the capacitance adjustment portions 13 so as to be reduced, preferably, become constant, and the widths of the respective individual electrodes 9 including the capacitance adjustment portions 13 are adjusted, so that the wiring resistances of the respective individual electrodes 9 are adjusted so as to be constant.

Figure 2:
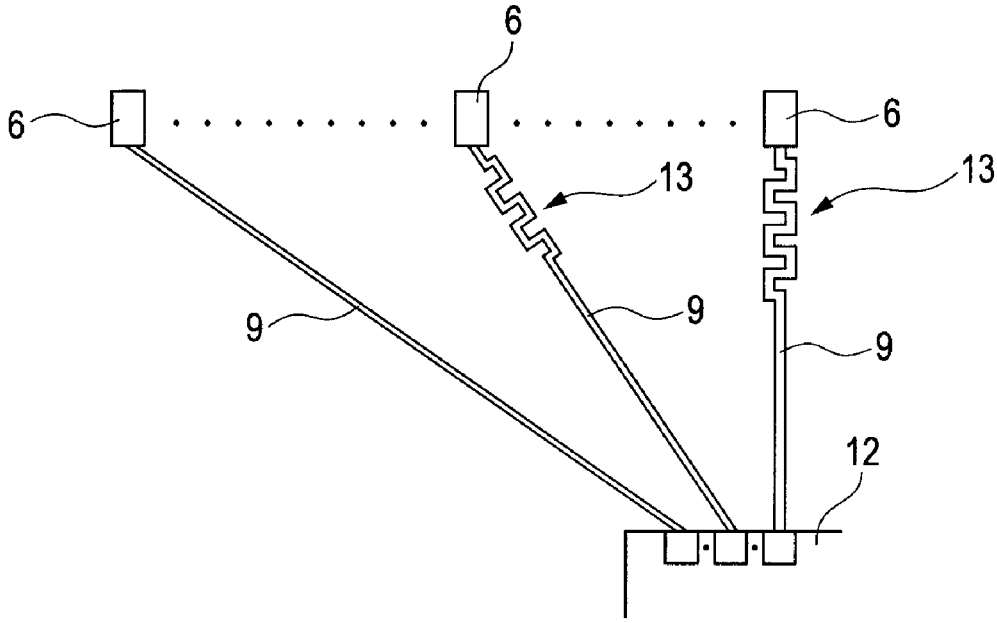
FIG. 2 is a view showing the configuration of main parts of a thermal head according to another embodiment of the invention.

The main lines 9*a* of the wiring pattern of the individual electrodes 9, which connect the driver IC 12 to the heat generating elements 6, may be bent in zigzags, that is, the capacitance adjustment portions 13 may be formed in a so-called meandering shape as shown in FIG. 2.

Figure 3A:
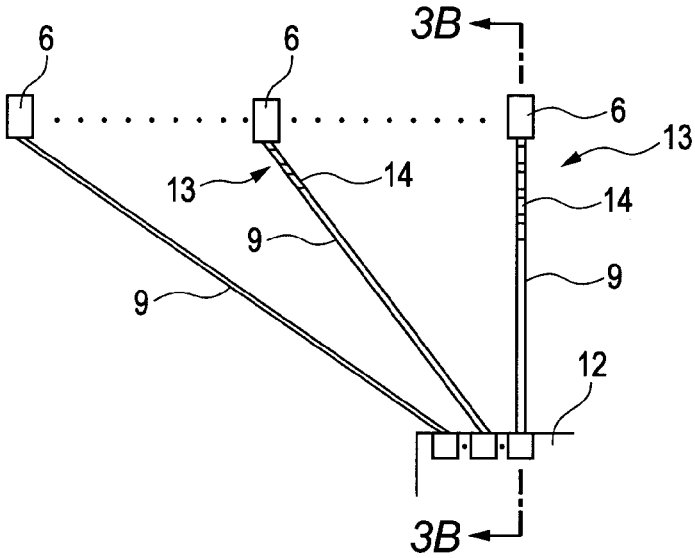
FIG. 3A is a view showing the configuration of main parts of a thermal head according to still another embodiment of the invention.
Figure 3B:
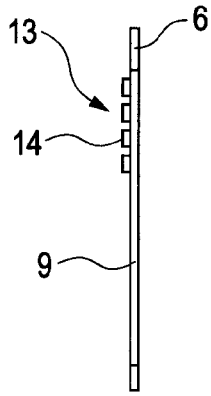
FIG. 3B is a cross-sectional view taken along a line A-A.

Alternatively, the conductors of the main lines 9*a* of the wiring pattern of the individual electrodes 9, which connect the driver IC 12 to the heat generating elements 6, may be formed so as to be partially thick as shown in FIG. 3. Meanwhile, the position where the capacitance adjustment portion 13 is formed at the individual electrode 9 will be further described below.

In the thermal head 1 having the above-mentioned configuration, the capacitance adjustment portions 13 are formed at the wiring pattern of the individual electrodes 9, so that the capacitance difference between the respective individual electrodes 9 connected to the respective heat generating elements 6 arranged in a main scanning direction of the thermal head 1 is reduced and variation in heat radiation property is suppressed. Further, it may be possible to make the heat generation of the heat generating elements 6 be uniform, remove unevenness in printing density, and obtain a good printing result by adjusting the wiring resistance of the wiring pattern of each individual electrode 9 when the capacitance adjustment portions 13 are formed.

Figure 8:
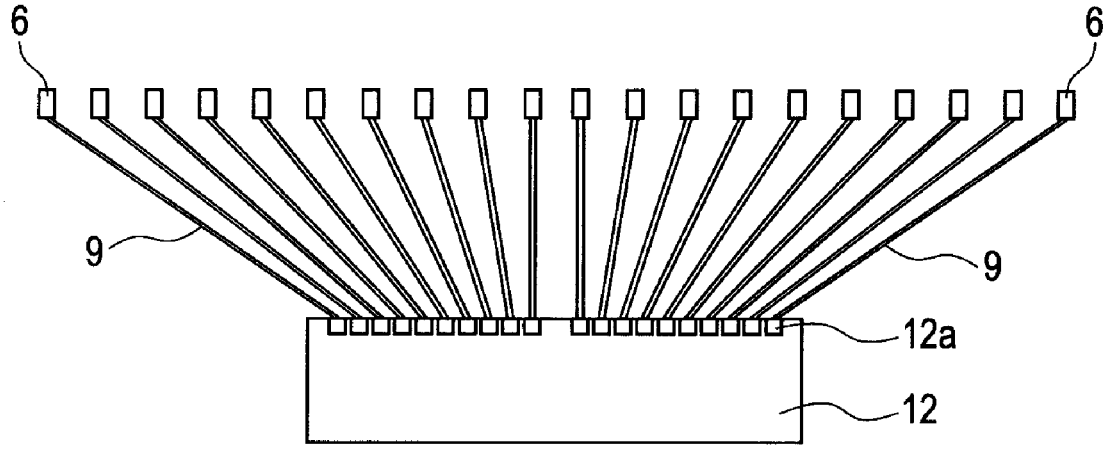
FIG. 8 is a view showing an example of the shape of a wiring pattern of individual electrodes that connect a driver IC to heat generating elements of a thermal head.

Here, in the thermal head 1 where the individual electrodes 9 connected to the terminals 12*c* of one driver IC 12 are formed of a wiring pattern spreading in the shape of a symmetrical fan toward the heat generating element 6 as described above, the distance between the terminals 12*a* formed at the end portion of the driver IC 12 and the heat generating element 6 corresponding to the terminal is largest and the distance between the terminal 12*a* formed in the middle of the driver IC 12 and the heat generating element 6 corresponding to the terminal is smallest (see FIG. 8). If the lengths of the wiring pattern of the individual electrodes 9 are not equal to each other as described above, it is preferable that the capacitance adjustment portions 13 formed at the wiring pattern of the individual electrodes 9 be designed so that the capacitance difference between the individual electrode 9 connected to the end portion of the driver IC 12 and the individual electrode 9 connected to the middle of the driver IC becomes 30% or less. Further, it is preferable that the capacitance difference between the individual electrodes be set to gradually decrease from the individual electrode 9 connected to the end portion of the driver IC toward the individual electrode 9 connected to the middle of the driver IC.

Figure 4:
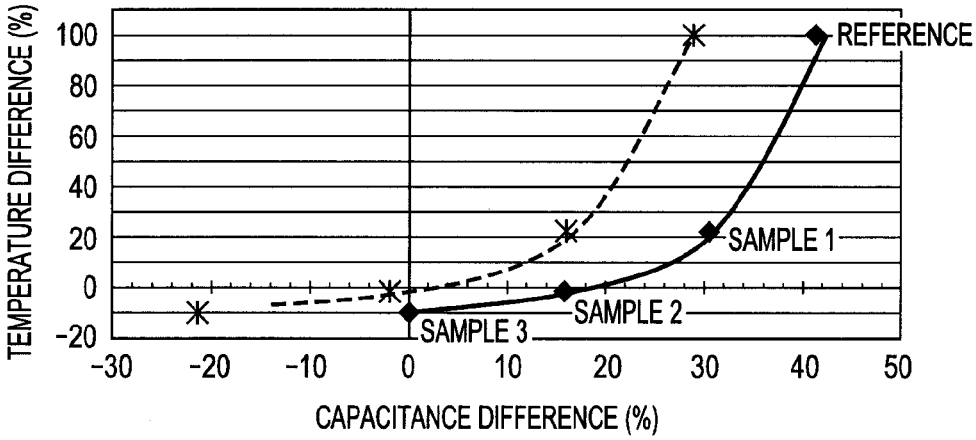
FIG. 4 is a view showing a graph (solid line) showing the results of a simulation for verifying the influence of capacitance difference, which is generated between an individual electrode connected to an end portion of a driver IC of a reference thermal head and an individual electrode disposed in the middle, on temperature difference and a graph (broken line) showing the results of a simulation for verifying the influence of capacitance difference, which is generated between an individual electrode connected to an end portion of a driver IC of a thermal head obtained by cutting the individual electrode of the reference thermal head to a distance of 1.4 mm from a heat generating element and an individual electrode disposed in the middle, on temperature difference, in an embodiment of the invention.

FIG. 4 is a graph showing the results of simulations for verifying the influence of capacitance difference, which is generated between the individual electrode 9 connected to the end portion of the driver IC 12 and the individual electrode 9 disposed in the middle, on temperature difference, more specifically, for verifying how much capacitance difference is reduced to improve the problem of temperature difference generated between the heat generating elements, in the thermal head 1 including a wiring pattern where the individual electrodes 9 are radially connected to the driver IC 12 as described above.

The thermal head 1, which is a reference in the simulations, is a thermal head having the specification in the related art where the capacitance of one individual electrode 9 connected to the middle of the driver IC is 60 when the capacitance of one individual electrode 9 connected to the end portion of the driver IC 12 is assumed as 100. That is, the capacitance difference between one individual electrode 9 connected to the end portion of the driver IC 12 of the thermal head 1 and one individual electrode 9 connected to the middle of the driver IC is 40% (=(1−the capacitance of one individual electrode connected to the middle of the driver IC/the capacitance of one individual electrode connected to the end portion of the driver IC)×100).

Further, comparative thermal heads 1 include a thermal head 1 (Sample 1) where the capacitance of one individual electrode 9 connected to the middle of the driver IC 12 of the reference thermal head 1 is increased so that the capacitance difference becomes 30%, a thermal head 1 (Sample 2) where the capacitance difference between individual electrodes is 16%, and a thermal head 1 (Sample 3) where the capacitance difference between individual electrodes is 0%.

Figure 5:
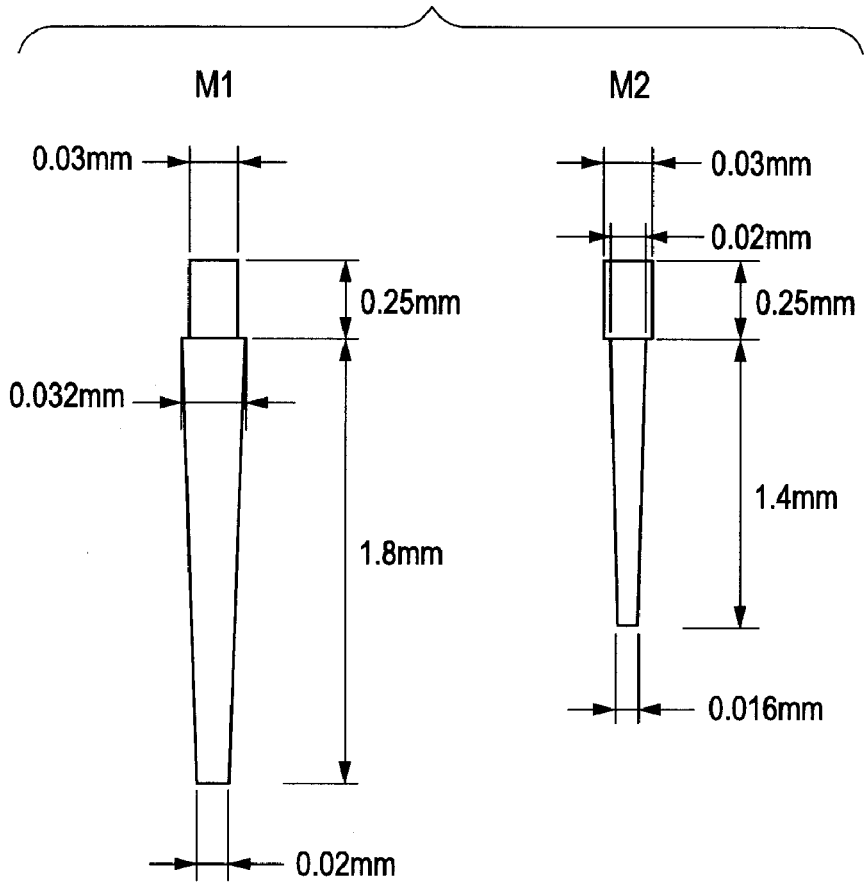
FIG. 5 is a view showing the shapes and dimensions of shape models that are Samples of the thermal head according to the embodiment of the invention.

In an actual simulation, a shape model M1 regarded as one individual electrode 9 connected to the end portion of the driver IC 12 and a shape model M2 regarded as one individual electrode 9 connected to the middle of the driver IC were prepared for each of the thermal heads 1 of the reference, Sample 1, Sample 2, and Sample 3; current was supplied to the respective thermal heads 1 under the same heat-generating resistance condition; and the temperature difference between the shape models M1 and M2 was measured. The conductor portions of the wiring pattern of the shape models M1 and M2 are formed in a linear shape toward the heat generating elements 6 so as to have the shapes, dimensions, and the like as shown in FIG. 5.

Meanwhile, in a table of FIG. 4, the temperature difference between one individual electrode 9 connected to the end portion of the driver IC 12 of the reference thermal head 1 and one individual electrode 9 connected to the middle of the driver IC (=the temperature of one individual electrode 9 connected to the middle of the driver IC—the temperature of one individual electrode 9 connected to the end portion of the driver IC) was assumed as 100% and the temperature difference between the individual electrodes having the same temperature was assumed as 0%; and a ratio of a numerical value of the temperature difference measured in each of the thermal heads 1 was calculated as the result of temperature difference (a temperature difference ratio). That is, the temperature difference ratio is a ratio (%) of the temperature difference of each thermal head 1 to the reference that is the temperature difference of the present thermal head 1, and it is shown that the problem of the temperature difference of the thermal head 1 in the related art is improved as the temperature difference ratio is decreased.

As a result, as shown in FIG. 4, the temperature difference of the thermal head (Sample 1) having a capacitance difference of 30% was 20% when the temperature difference of the reference thermal head 1 was assumed as 100%, and the temperature difference of the thermal head 1 (Sample 2) having a capacitance difference of 16% was 0% when the temperature difference of the reference thermal head 1 was assumed as 100%. Further, the temperature difference of the thermal head 1 (Sample 3) having a capacitance difference of 0% was −10% when the temperature difference of the reference thermal head 1 was assumed as 100%. The negative value of the temperature difference means that the temperature of the individual electrode 9 connected to the end portion of the driver IC 12 is higher than that of the individual electrode 9 connected to the middle of the driver IC in the reference thermal head 1.

Meanwhile, if variation in heat generation of the heat generating element 6 not affecting a printing result is allowable, a thermal head 1 having a temperature difference of 10% or less is preferable in practice.

Accordingly, when capacitance difference in the range of 0%±10% of temperature difference is found from the approximate curves of the measurement results of the respective thermal heads 1 of the reference, Sample 1, and Sample 2 shown in FIG. 4, the problem of variation in the temperature difference of the present thermal head 1 is solved if capacitance difference is in the range of 0 to 26%. Further, since temperature difference is 20% even at the capacitance difference of 30%, it was found that the problem was significantly improved.

Accordingly, in this embodiment, the capacitance adjustment portions 13 are designed so that the capacitance difference between the individual electrodes 9 becomes 30% or less, unevenness in printing density is removed by making the heat generation of the heat generating elements be uniform, and a good printing result is obtained.

Further, it is important that the capacitance adjustment portion 13 is formed at each individual electrode 9 in the range of 1.4 mm or less from the heat generating element 6.

That is, in the above-mentioned simulations, the temperature difference of the thermal head 1 of Sample 2 having a capacitance difference of 16% was 0%, a relationship between the amount of heat generated from the individual electrode 9 connected to the end portion of the driver IC 12 and the amount of heat generated from the individual electrode 9 connected to the middle of the driver IC in the thermal head 1 of Sample 3 having a capacitance difference of 0% were reverse to that in the reference thermal head 1, and the temperature difference of the thermal head 1 of Sample 3 was 10%. However, if capacitance difference is 0%, temperature difference is theoretically to be 0%. From this result, it was forecasted that capacitance would be added in the range that does not affect the heat radiation (temperature difference) in the individual electrode 9. Accordingly, there was performed an experiment for specifying this range.

In this experiment, first, the shape models M1 and M2 of the thermal head 1 of Sample 2, which had a temperature difference of 0% and a capacitance difference of 16% in the above-mentioned simulations, are used. The portions, which are not connected to the heat generating elements 6, of the wiring pattern of the shape models are cut so that the lengths of the wiring pattern from the heat generating elements 6 become 1.8 mm (Sample 4=Sample 2), 1.5 mm (Sample 5), 1.35 mm (Sample 6), 1.25 mm (Sample 7), and 1.0 mm (Sample 8), and the capacitance difference between two shape models M1 and M2 of each Sample was measured.

Figure 6:
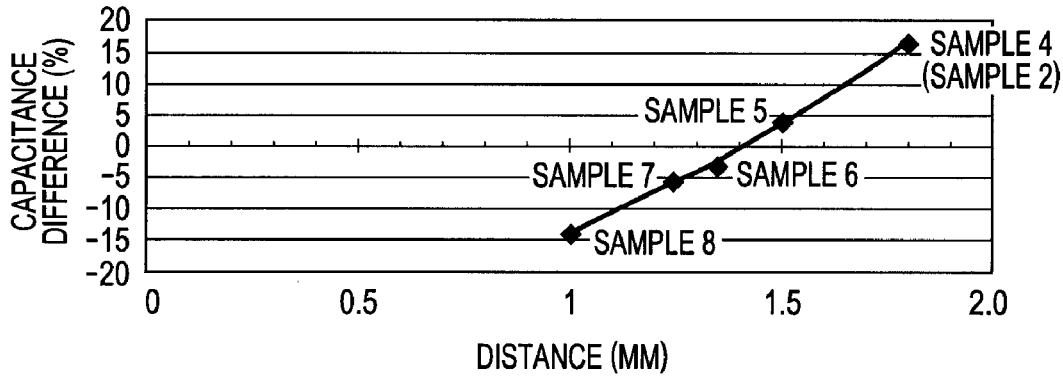
FIG. 6 is a graph showing the results of capacitance difference of shape models of which individual electrodes are cut with different distances from heat generating elements in the shape models of a thermal head of Sample 2.

As shown in a table of FIG. 6, according to the measurement results, the capacitance difference of Sample 4 was 16%, the capacitance difference of Sample 5 was 4%, the capacitance difference of Sample 6 was −3%, the capacitance difference of Sample 7 was −6%, and the capacitance difference of Sample 8 was −14%.

Further, according to the approximate curve of the measurement results, it was found that capacitance difference was 0% when a distance from the heat generating element 6 was 1.4 mm.

Meanwhile, for the shape models M1 and M2 regarded as one individual electrode 9 connected to the end portion of the driver IC 12 of each of the thermal heads of the above-mentioned reference, Sample 1, Sample 2, and Sample 3 and one individual electrode 9 connected to the middle of the driver IC thereof, the wiring pattern cut in the range of 1.4 mm or more from the heat generating element 6 was prepared and the influence of capacitance difference, which was generated between the individual electrode 9 connected to the end portion of the driver IC 12 and the individual electrode 9 disposed in the middle, on temperature difference was simulated in the same way as those of the above-mentioned simulations.

As a result, since the wiring pattern of 1.4 mm or more was cut as shown by a broken line (approximate curve) of FIG. 4, it was found that the capacitance difference of the cut wiring pattern was changed as compared to when the wiring pattern was not cut yet but the temperature difference thereof was not nearly changed. It was proved that the range of the wiring pattern of 1.4 mm or more from the heat generating element did not affect temperature difference.

Accordingly, the capacitance adjustment portion 13 of this embodiment is formed in the range of each individual electrode 9 of 1.4 mm or less from the heat generating element 6 and the addition of capacitance, which does not contribute to the uniformization of the heat radiation difference of each individual electrode 9, is excluded, so that it may be possible to improve an effect without variation.

Meanwhile, the invention is not limited to the above-mentioned embodiments, and may have various modifications if necessary.

Further, the arrangement of the heat generating element relative to each driver IC is not limited to the case where the driver ICs are provided so as to correspond to the middle in the arrangement of the heat generating elements as described above. Accordingly, the shape of the wiring pattern of the individual electrodes is also limited to the above-mentioned radial shape.

Furthermore, the position of each driver IC is not limited to a position on the head substrate 2. For example, each driver IC may be provided on another printed-circuit board.

It should be understood by those skilled in the art that various modifications, combinations, sub-combinations and alterations may occur depending on design requirements and other factors insofar as they are within the scope of the appended claims of the equivalents thereof.

What is claimed is:

1. A thermal head comprising:

an insulating substrate;

one or a plurality of driver ICs;

a plurality of heat generating elements that is arranged on the substrate in a main scanning direction;

a plurality of individual electrodes that is provided on the substrate at one ends of the respective heat generating elements and connects the respective heat generating elements to the driver ICs; and a common electrode that is provided on the substrate at the other ends of the respective heat generating elements so as to be common to the heat generating elements, wherein capacitance adjustment portions, which adjust capacitance difference between the respective individual electrodes so that the capacitance difference is reduced, are formed at a wiring pattern of the individual electrodes.

2. The thermal head according to claim 1, wherein the wiring pattern of the individual electrodes is formed so that the wiring resistances of the respective individual electrodes are adjusted so as to be constant.

3. The thermal head according to claim 2, wherein at least one branch line, which laterally extends from main lines, is formed at main lines of the wiring pattern of the individual electrodes, which connect the driver IC to heat generating elements, as the capacitance adjustment portions, and adjusts the wiring resistance of each of the individual electrodes so that the wiring resistance of each of the individual electrodes is constant.

4. The thermal head according to claim 2, wherein main lines of the wiring pattern of the individual electrodes, which connect the driver IC to heat generating elements, are formed in a meandering shape so that the capacitance adjustment portions are formed, and the capacitance adjustment portions adjust the wiring resistance of each of the individual electrodes so that the wiring resistance of each of the individual electrodes is constant.

5. The thermal head according to claim 2, wherein conductors of main lines of the wiring pattern of the individual electrodes, which connect the driver IC to the heat generating elements, are formed so as to be partially thick as the capacitance adjustment portions, and adjust the wiring resistance of each of the individual electrodes so that the wiring resistance of each of the individual electrodes is constant.

* * * * *